US007262706B2

(12) United States Patent
Yang et al.

(10) Patent No.: US 7,262,706 B2
(45) Date of Patent: Aug. 28, 2007

(54) DETECTION OF CONNECTION AND DISCONNECTION OF COMPUTER PERIPHERAL

(75) Inventors: Xiaoping Yang, Shanghai (CN); Kenny He, Shanghai (CN)

(73) Assignee: Intel Corporation, Santa Clara, CA (US)

( * ) Notice: Subject to any disclaimer, the term of this patent is extended or adjusted under 35 U.S.C. 154(b) by 147 days.

(21) Appl. No.: 11/026,569

(22) Filed: Dec. 30, 2004

(65) Prior Publication Data

US 2006/0152381 A1 Jul. 13, 2006

(51) Int. Cl.
*G08B 21/00* (2006.01)

(52) U.S. Cl. ..... 340/656; 340/657; 340/687

(58) Field of Classification Search ..... 340/687, 340/656, 657, 531, 532, 533, 568.2; 395/283, 395/284, 828; 710/8, 9, 106, 304
See application file for complete search history.

(56) References Cited

U.S. PATENT DOCUMENTS 5,034,727 A * 7/1991 Muraoka ..... 340/652
5,768,541 A * 6/1998 Pan-Ratzlaff ..... 710/304
5,781,744 A * 7/1998 Johnson et al. ..... 710/304
6,459,374 B1 * 10/2002 Rand et al. ..... 340/568.2
6,460,094 B1 * 10/2002 Hanson et al. ..... 710/8

OTHER PUBLICATIONS

Office Action from U.S. Appl. No. 11/027,232 mailed on Sep. 6, 2006, pp. 5.

* cited by examiner

*Primary Examiner*—Van T. Trieu
(74) *Attorney, Agent, or Firm*—Rob D. Anderson

(57) ABSTRACT

In some embodiments a connector is to couple a peripheral, and a detector coupled to the connector is to detect if the peripheral is disconnected from the connector in response to a first reserved pin and a second reserved pin.

22 Claims, 7 Drawing Sheets

| Pin Number | Signal Name |
|---|---|
| 1 | Data |
| 2 | - |
| 3 | GND |
| 4 | +5V |
| 5 | Clock |
| 6 | - |

DETECTION OF CONNECTION AND DISCONNECTION OF COMPUTER PERIPHERAL

This application is related to a U.S. patent application No. 11/027,232 filed on the same date as this application and entitled "Detection of Connection and Disconnection of Computer Peripheral" to Xiaoping Yang and Kenny He.

TECHNICAL FIELD

The inventions generally relate to detection of connection and disconnection of a computer peripheral.

BACKGROUND

Theft of computer peripherals such as keyboards, mice, etc. is becoming a problem, particularly in some locations and in some types of use (for example, internet cafes). Some mechanical solutions exist to prevent keyboards from being stolen. However, such solutions do not include any alert signal to be sent to a console so that a supervisor is aware of the attempted theft. Further, if a thief cuts a mechanical cable the mechanical solutions are rendered useless and the theft is successful. No current electrical solutions exist to detect a state of connection and/or disconnection of a keyboard, particularly when the system is in an S5 power state.

Current solutions for theft prevention of a mouse include a mechanical solution and a smart contactless detection mechanism. The cost of both of these options is high, and neither allow for any alert to be sent or remote management to be implemented.

BRIEF DESCRIPTION OF THE DRAWINGS

The inventions will be understood more fully from the detailed description given below and from the accompanying drawings of some embodiments of the inventions which, however, should not be taken to limit the inventions to the specific embodiments described, but are for explanation and understanding only.

DETAILED DESCRIPTION

Some embodiments of the inventions relate to detection of connection and disconnection of a computer peripheral.

In some embodiments a connector is to couple a peripheral, and a detector coupled to the connector is to detect if the peripheral is disconnected from the connector in response to a reserved pin and a power pin.

In some embodiments a system includes a computer and a peripheral having a reserved pin and a power pin. The computer includes a connector to couple the peripheral to the computer and a detector coupled to the connector to detect if the peripheral is disconnected from the connector in response to the reserved pin and the power pin.

Some embodiments relate to coupling to a reserved pin of a peripheral and a power pin of the peripheral, and detecting a disconnection of the peripheral from a system in response to the reserved pin and the power pin.

In some embodiments a connector is to couple a peripheral, and a detector coupled to the connector is to detect if the peripheral is disconnected from the connector in response to a first reserved pin and a second reserved pin.

In some embodiments a system includes a computer and a peripheral having a first reserved pin and a second reserved pin. The computer includes a connector to couple the peripheral to the computer and a detector coupled to the connector to detect if the peripheral is disconnected from the connector in response to the first reserved pin and the second reserved pin.

Some embodiments relate to coupling to a first reserved pin of a peripheral and a second reserved pin of the peripheral, and detecting a disconnection of the peripheral from a system in response to the first reserved pin and the second reserved pin.

Figure 1:
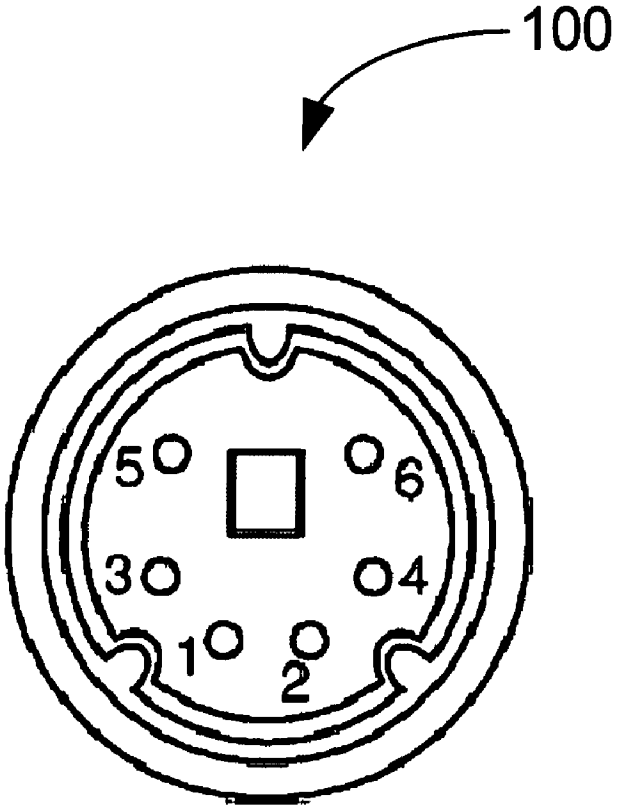
FIG. 1 illustrates a PS2 keyboard plug according to some embodiments of the inventions.

FIG. 1 illustrates a PS2 keyboard plug 100. The PS2 keyboard plug 100 includes six pins. Pin 1 is a data pin, pin 2 is a pin that is reserved and not typically used (not implemented), pin 3 is a ground voltage pin (GND), pin 4 is a Vcc voltage pin (typically 5 volts), pin 5 is a clock pin, and pin 6 is a pin that is reserved and not typically used (not implemented). In current PS2 keyboards pin 2 is not used or implemented. In some embodiments, however, the reserved pin 2 of the PS2 keyboard plug 100 is used to detect the disconnection and connection of the keyboard (for example in an S5 power state, an S3 power state, or an S0 power state when the power cord of the computer is plugged in).

Figure 2:
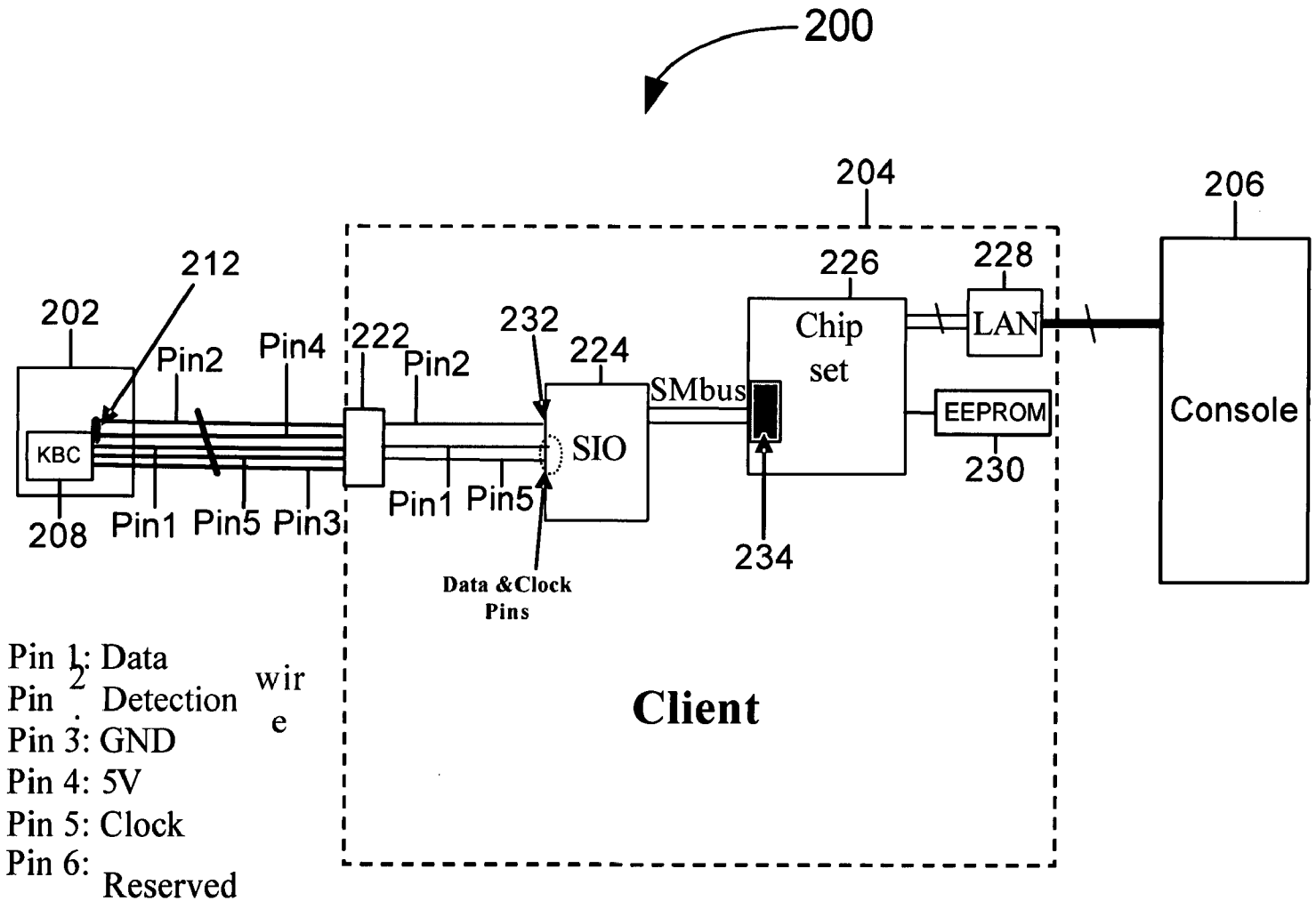
FIG. 2 illustrates a system according to some embodiments of the inventions.

FIG. 2 illustrates a system 200 including a keyboard 202, a client 204, and a console 206 according to some embodiments. In some embodiments keyboard 202 is a PS2 keyboard. In some embodiments client 204 is a client computer (for example a client personal computer or client PC). In some embodiments console 206 is a console computer, a console PC, and/or a server.

In some embodiments keyboard 202 is a PS2 keyboard including a keyboard controller 208. In some embodiments keyboard controller 208 is a controller chip (or also referred to as a controller Integrated Circuit or controller IC). In some embodiments pin 2 of the plug of keyboard 202 is shorted with pin 4 of the plug of keyboard 202. In some embodiments pin 2 of the plug of keyboard 202 is shorted with pin 4 of the plug of keyboard 202 in a location that is close to the keyboard controller 208. For example, pin 2 is shorted with pin 4 at the location identified by arrow 212 in FIG. 2. In this manner the reserved pin 2 of the PS2 plug of keyboard 202 may be used to detect connection and/or disconnection of keyboard 202 from the client 204.

In some embodiments client 204 includes a connector 222 (for example, a PS2 connector), a Serial Input/Output (SIO) device 224, a chip set 226, a LAN (Local Area Network) module 228, and an EEPROM (Electrically Erasable Programmable Read Only Memory) 230. In some embodiments connector 222 is a PS2 connector. In some embodiments SIO device 224 is an integrated circuit (IC). In some embodiments chip set 226 is a portion of a chip set. In some embodiments chip set 226 is an ICH (I/O Controller Hub). In some embodiments chip set 226 is an ICH5 Intel chip or in some embodiments chip set 226 is an ICH6 Intel chip. In some embodiments LAN module 228 is a LAN controller. In some embodiments LAN module 228 is a chip that couples client 204 to console 206. In some embodiments LAN controller 228 is a fast Ethernet controller (for example, a Platform LAN Connect PLC device such as the Intel 82562 family of controllers). In some embodiments EEPROM 230 is any type of memory.

Reserved pin 2, voltage (5V) pin 4, data pin 1, clock pin 5, and ground voltage (GND) pin 3 are each coupled between keyboard 202 and the connector 222 of client 204. Data pin 1 and clock pin 5 signals are provided between the connector 222 and the SIO device 224. Additionally, a signal wire to connect the pin 2 signal to a signal sensor 232 of the SIO 224 is added between connector 222 and SIO device 224 (for example, by adding a wire on a motherboard of client 204). When keyboard 202 is plugged into the connector 222, pin 2 will then continuously have a 5 V high state that triggers sensor 232. If keyboard 202 is disconnected from the connector 222 or the cable between keyboard 202 and client 204 is cut off then pin 2 will have a 0 V low state that triggers sensor 232 of the SIO 224. State signals are transmitted from SIO device 224 to an Alert Standard Format (ASF) circuit 234 of the chip set 226, for example, via an SMBus (System Management bus). Once the chip set 226 and/or the ASF circuit 234 has processed the signals transmitted from the SIO device 224 an ASF event is generated and sent out to the console 206 via the LAN module 228.

There are currently no solutions for anti-theft of a computer peripheral such as a keyboard or a mouse (for example, in an S5, an S3, or an S0 power state) that use motherboard technology. There are also no solutions that provide an electrical solution to anti-theft of a peripheral such as a keyboard or a mouse in different states (for example, in an S5, an S3, or an S0 power state) or that use ASF technology. The system of FIG. 2 is not only helpful in anti-theft and/or anti-vandalism by preventing a computer peripheral such as a keyboard (or a mouse) from being stolen and/or broken, but is also may be used to do remote management of other key devices (for example, while the client is in an S5 power state). Further, it allows signals to be sent to a console 206 such as a PC console or server to provide an alert regarding potential theft or vandalism to the keyboard 202. Some embodiments could be implemented in internet cafes (for example, the upcoming iCafe product that is currently scheduled to be launched in China in 2005), in schools, in training classrooms, in businesses, etc.

In some embodiments a very inexpensive and relatively simple solution is provided. For example, in volumes over 100,000 the solution can be implemented at a cost of approximately one cent per device. Additionally, according to some embodiments if a keyboard such as that described herein is plugged into a computer that does not have features of some embodiments it will still function, and performance is not impacted other than that the anti-theft feature is disabled. In some embodiments, the keyboard can be remotely monitored and/or controlled by a console such as a console PC or server(s) at all times.

In some embodiments FIG. 1 allows use of one or more reserved pins of a PS2 keyboard. Since a PS2 keyboard only needs four pins for normal operation but include six pins, the keyboard 202 may be reworked to provide one pin that is used for anti-theft and/or anti-vandalism detection (for example, by shorting a reserved pin with the power pin). In some embodiments, the keyboard 202 may be reworked by adding a fifth wire into the keyboard cable (if the standard cable only includes the standard four wires), and shorting the new added wire with the existing power (5 V) wire, in some embodiments in a location near a connection location with the keyboard controller 208. Additionally, a wire may be added to a typical motherboard wire layout to connect the new wire with, for example, a free legacy sensor of the SIO device or an ASF sensor of the SIO device, or a hardware monitor IC. In some embodiments when keyboard 202 is connected with the connector 222 (for example, a PS2 connector), for example in an S5 state, a Vcc pin of the connector generally has 5 V standby voltage (since the power cable is plugged into the power supply unit or PSU of the client system 204). If the Vcc pin does not generally have 5 V standby voltage the Vcc pin of the connector may be changed to 5 V standby voltage using ACPI technology (Advanced Configuration and Power Interface). The newly added wire (for example, pin 2) will then also have a 5 V standby voltage that is input into the sensor 232. In some embodiments the signal status of the sensor 232 is then polled by the ASF circuit 234 and/or chip set 226 (for example, an ICH5 chip), and sent to a remote console 206 (for example, a remote server console) via LAN (it is noted that a LAN module is generally active even in an S5 "power off" state). In some embodiments console 206 receives a signal that indicates the keyboard is connecting with the system 204. Otherwise, if the keyboard 202 is disconnected or cut-down (for example, the cord between the keyboard 202 and the system 204 is cut), the console 206 will receive another state signal that indicates that the keyboard 202 has been disconnected from the system 204.

Although some embodiments of FIG. 2 have been illustrated and described herein as applying to a keyboard, some embodiments of FIG. 2 can be applied to a peripheral other than a keyboard (for example, a mouse).

Figure 3:
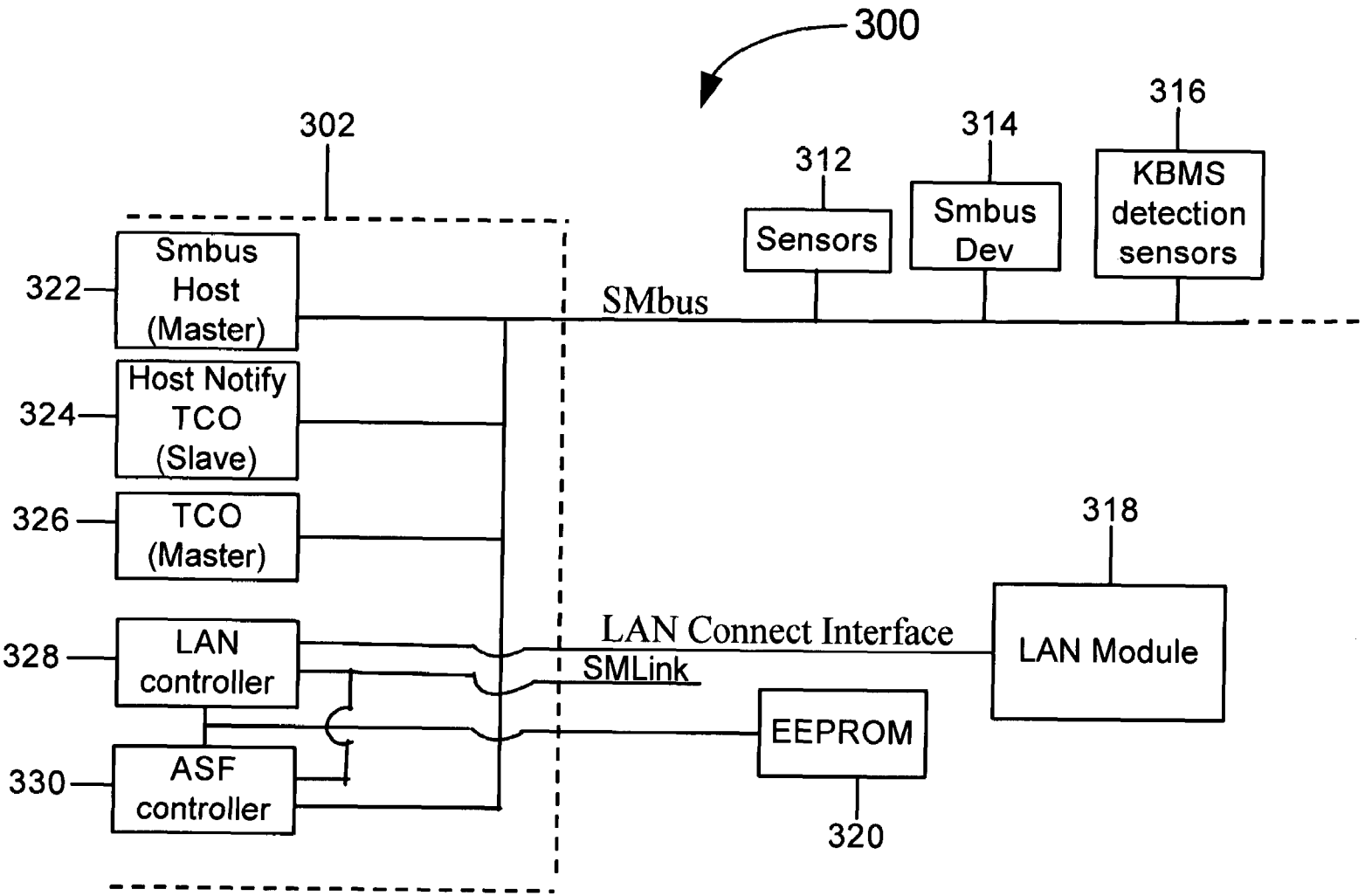
FIG. 3 illustrates a system according to some embodiments of the inventions.

FIG. 3 illustrates an ASF arrangement 300 including ASF architecture according to some embodiments. The ASF arrangement 300 includes ASF circuitry shown inside a dotted line 302 in FIG. 3, and also illustrates how the ASF circuitry 302 couples with sensors 312, SMBus Dev 314 (SMBus device), and KBMS (keyboard/mouse) detection sensors 316 via a System Management bus (SMBus). ASF circuit 302 is also coupled to a LAN module 318 via a LAN connect interface. ASF circuit 302 is also coupled to a memory (for example an EEPROM) 320. ASF circuit 302 includes an SMBus host (master) 322, a Host Notify TCO (slave) 324, a TCO (master) 326, a LAN controller 328, and an ASF controller 330. In some embodiments SMBus host (master) 322 hosts the SMBus and is the master of the SMBus. In some embodiments the host notify TCO (slave) 324 and TCO (master) 326 are similar to those devices included in, for example, the ASF core circuitry within an Intel chip set. In some embodiments ASF controller 330 is an Alert Standard Format management controller that acts in conjunction with LAN controller 328 to enable system monitoring devices to communicate through the LAN controller 328 to the LAN network through LAN module 318.

Figure 4:
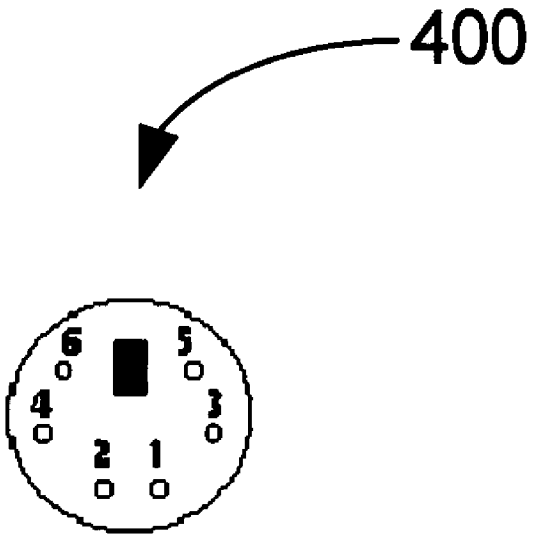
FIG. 4 illustrates a PS2 mouse plug according to some embodiments of the inventions.

FIG. 4 illustrates a PS2 mouse plug 400 (for example, a female socket mouse plug). In some embodiments plug 400 is a six pin mini-DIN PS/2 plug. The PS2 mouse plug 400 includes six pins. Pin 1 is a data pin, pin 2 is a pin that is reserved and not typically used (not implemented), pin 3 is a ground voltage pin (GND), pin 4 is a Vcc voltage pin (typically 5 volts), pin 5 is a clock pin, and pin 6 is a pin that is reserved and not typically used (not implemented). In current PS2 mice pins 2 and 6 are not used or implemented. In some embodiments, however, the reserved pins 2 and 6 may be used in a client to detect the disconnection and connection of the mouse (for example in an S5 power state, an S3 power state, or an S0 power state when the power cord of the computer is plugged in).

Figure 5:
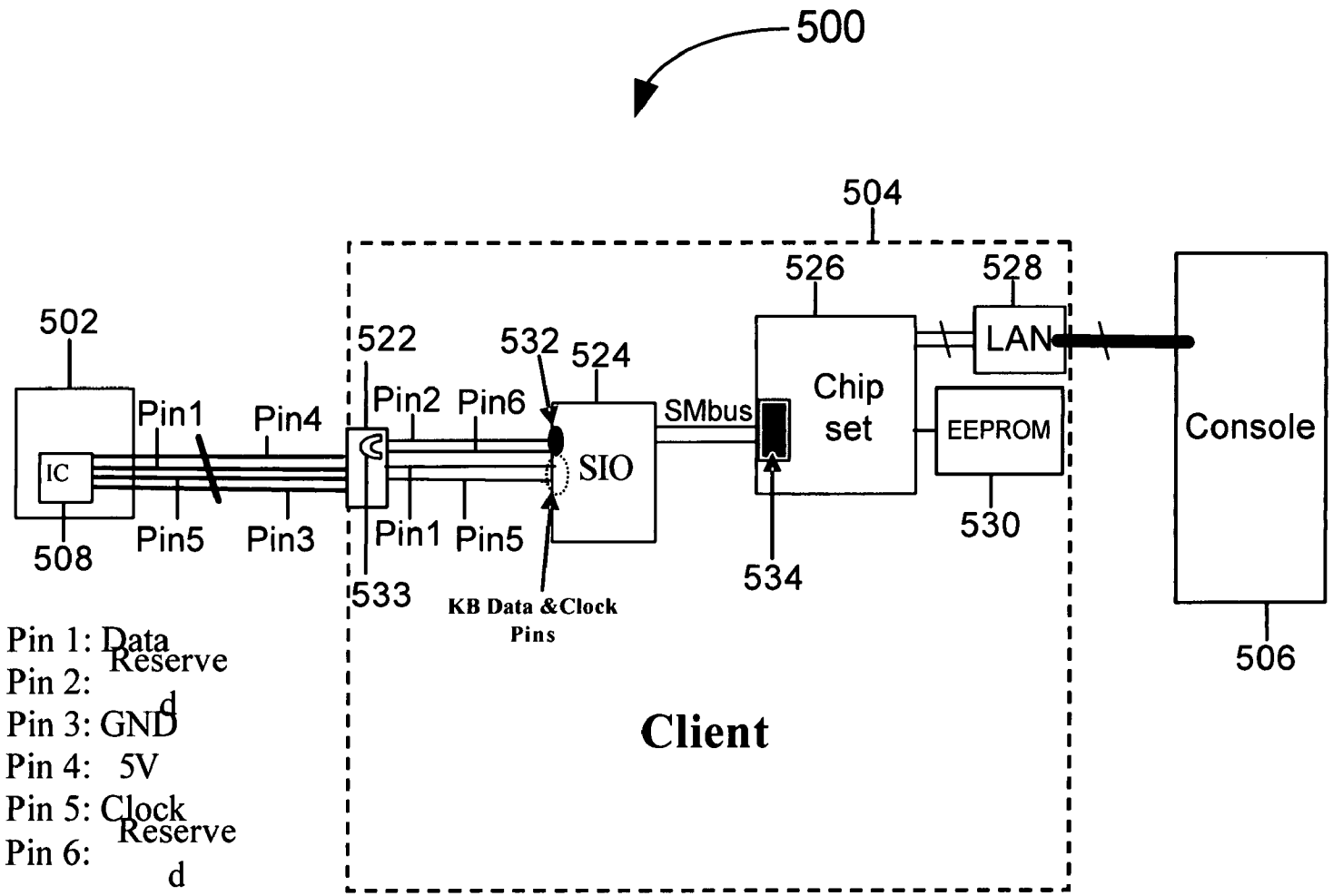
FIG. 5 illustrates a system according to some embodiments of the inventions.

FIG. 5 illustrates a system 500 including a mouse 502, a client 504, and a console 506 according to some embodiments. In some embodiments mouse 502 is a PS2 mouse. In some embodiments client 504 is a client computer (for example a client personal computer or client PC). In some embodiments console 506 is a console computer, a console PC, and/or a server.

In some embodiments mouse 502 is a PS2 mouse including a controller 508. In some embodiments controller 508 is a controller chip (or also referred to as a controller Integrated Circuit or controller IC).

In some embodiments client 504 includes a connector 522 (for example, a PS2 connector), a Serial Input/Output (SIO) device 524, a chip set 526, a LAN (Local Area Network) module 528, and an EEPROM (Electrically Erasable Programmable Read Only Memory) 530. In some embodiments connector 522 is a PS2 connector. In some embodiments SIO device 524 is an integrated circuit (IC). In some embodiments chip set 526 is a portion of a chip set. In some embodiments chip set 526 is an ICH (I/O Controller Hub). In some embodiments chip set 526 is an ICH5 Intel chip and in some embodiments chip set 526 is an ICH6 Intel chip. In some embodiments LAN module 528 is a LAN controller. In some embodiments LAN module 528 is a chip that couples client 504 to console 506. In some embodiments LAN controller 528 is a fast Ethernet controller (for example, a Platform LAN Connect PLC device such as the Intel 82562 family of controllers). In some embodiments EEPROM 530 is any type of memory.

Voltage (5 V) pin 4, data pin 1, clock pin 5, and ground voltage (GND) pin 3 are each coupled between mouse 502 and the connector 522 of client 504. Reserved pin 2, reserved pin 6, Data pin 1, and clock pin 5 signals are provided between the connector 522 and the SIO device 524. The reserved pin 2 and reserved pin 6 are coupled to connector 522 with two signal wires connecting them to a signal sensor 532 of the SIO 524 that are added between connector 522 and SIO device 524 (for example, by adding two wires on a motherboard of client 504). The two reserved pins 2 and 6 of the connector 522 (for example, a PS2 connector) and a mechanical switch 533 that is added to connector 522 are used to trigger the sensor 532. When the mouse 502 is plugged into the connector 522, switch 533 is shorted and a high voltage level may be input to the sensor 532. Due to inverting characteristics of the sensor 532, it will not trigger and generate a state signal to an ASF core 534 when the mouse 502 is plugged into the connector 522. The ASF core 534 sends a signal package to the console 506 via LAN module 528, which informs the console 506 that the mouse is being connected with the connector 522 (for example, a PS2 connector). When and if the mouse 502 is unplugged from the connector 522, the switch 533 is opened and a low voltage level is output to the sensor 532. Similarly, due to inverting characteristics of the sensor 532 a state signal will be triggered and generated to the ASF core 534. Then the ASF management core 534 provides a signal package to the console 506 to indicate that the mouse 502 has been stolen, dropped, had it's cord cut, etc. to inform, for example, an IT manager monitoring the console of the potential theft, vandalism, etc. All of these actions can be implemented in some embodiments in S5, S3, and S0 states, for example.

As discussed above, there are currently no solutions for anti-theft of a computer peripheral such as a keyboard or a mouse (for example, in an S5, an S3, or an S0 power state) that use motherboard technology. There are also no solutions that provide an electrical solution to anti-theft of a peripheral such as a keyboard or a mouse in different states (for example, in an S5, an S3, or an S0 power state) or that use ASF technology. The system of FIG. 5 is not only helpful in anti-theft and/or anti-vandalism by preventing a computer peripheral such as a keyboard (or a mouse) from being stolen and/or broken, but is also may be used to do remote management of other key devices (for example, while the client is in an S5 power state). Further, it allows signals to be sent to a console 506 such as a PC console or server to provide an alert regarding potential theft or vandalism to the mouse 502. Some embodiments could be implemented in internet cafes (for example, the upcoming iCafe product that is currently scheduled to be launched in China in 2005), in schools, in training classrooms, in businesses, etc.

In some embodiments a very inexpensive and relatively simple solution is provided. For example, in volumes over 100,000 the solution can be implemented at a cost of approximately one cent per device. In some embodiments, the mouse (or other computer peripheral such as a keyboard) can be remotely monitored and/or controlled by a console such as a console PC or server(s) at all times.

In some embodiments FIG. 4 allows use of one or more reserved pins of a PS2 mouse. Since a PS2 mouse only needs four pins for normal operation but include six pins, the connector 522 may be reworked to add a switch and two signal lines (reserved pin 2 and reserved pin 6) that is used for anti-theft and/or anti-vandalism detection (for example, by shorting the two reserved pins together. Additionally, two wires may be added to a typical motherboard wire layout to connect the new wires with, for example, a free legacy sensor of the SIO device or an ASF sensor of the SIO device, or a hardware monitor IC. In some embodiments console 506 receives a signal that indicates the mouse (or other peripheral such as a keyboard) is connecting with the system 504. Otherwise, if the mouser 502 is disconnected or cut-down (for example, the cord between the mouse 502 and the system 504 is cut), the console 506 will receive another state signal that indicates that the mouse 502 has been disconnected from the system 504.

Although some embodiments of FIG. 5 have been illustrated and described herein as applying to a mouse, some embodiments of FIG. 5 can be applied to a peripheral other than a mouse (for example, a keyboard).

Figure 6:
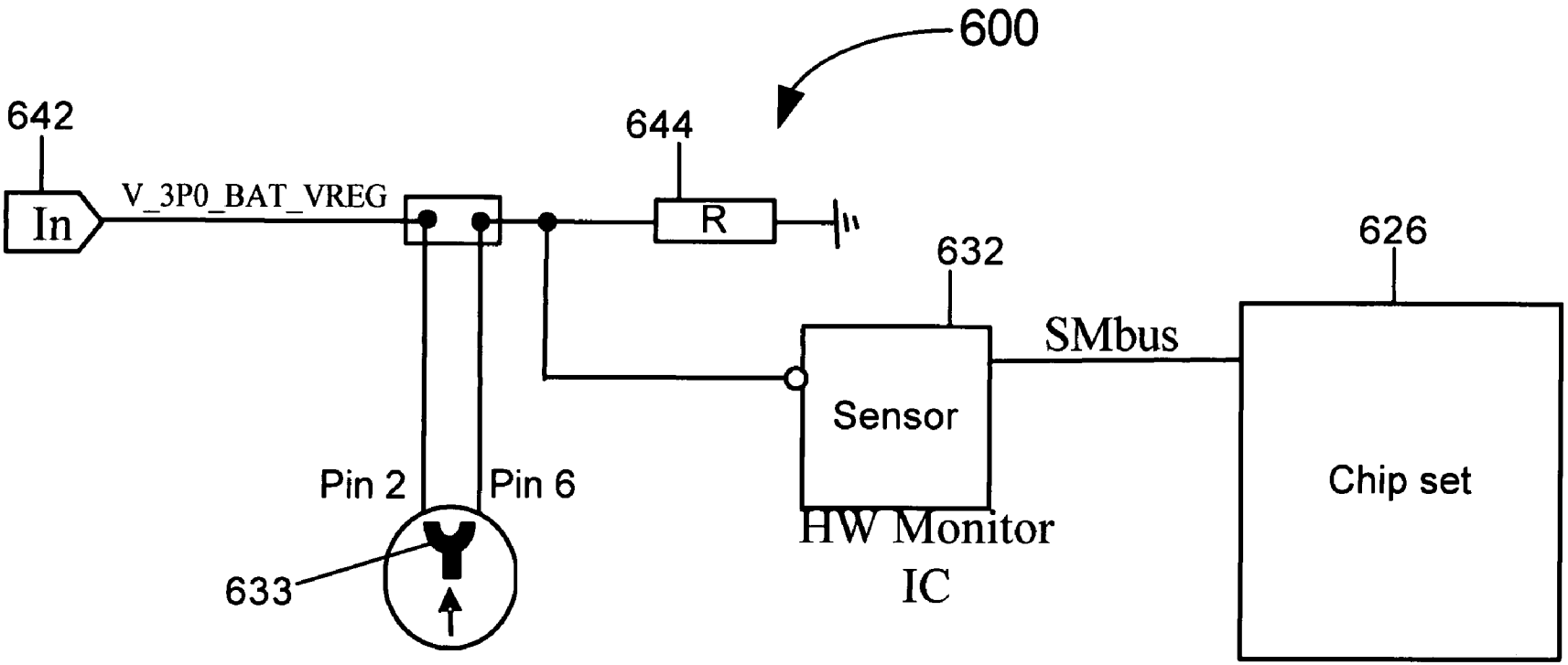
FIG. 6 illustrates a circuit according to some embodiments of the inventions.

FIG. 6 illustrates a circuit 600 to detect the status of a computer peripheral (for example, a mouse) according to some embodiments. Circuit 600 includes a chip set 626, a sensor 632, and a switch 633, for example. Circuit 600 can also include an input signal 642 (for example, a battery/voltage regulated signal) and a resistor 644. When and if the mouse or other computer peripheral is plugged into a connector, the switch 633 is shorted and a high voltage level may be input to the sensor 632. Due to inverting characteristics of the sensor 632, it will not trigger and generate a state signal to chip set 626 when the mouse or other computer peripheral is plugged into the connector 622. The chip set 626 (for example, using an ASF core) sends a signal package to a console which informs the console that the mouse or other peripheral is being connected with the connector (for example, a PS2 connector).

When a mouse (or other computer peripheral such as a keyboard) is unplugged from the connector, the switch 633 is opened and a low voltage level is output to the sensor 632. Similarly, due to inverting characteristics of the sensor 632 a state signal will be triggered and generated to chip set 626. Then the chip set 626 (for example, using an ASF core)

provides a signal package to a console to indicate that the mouse (or other computer peripheral) has been stolen, dropped, had it's cord cut, etc. to inform, for example, an IT manager monitoring the console of the potential theft, vandalism, etc. All of these actions can be implemented in some embodiments in S5, S3, and S0 states, for example.

Figure 7:
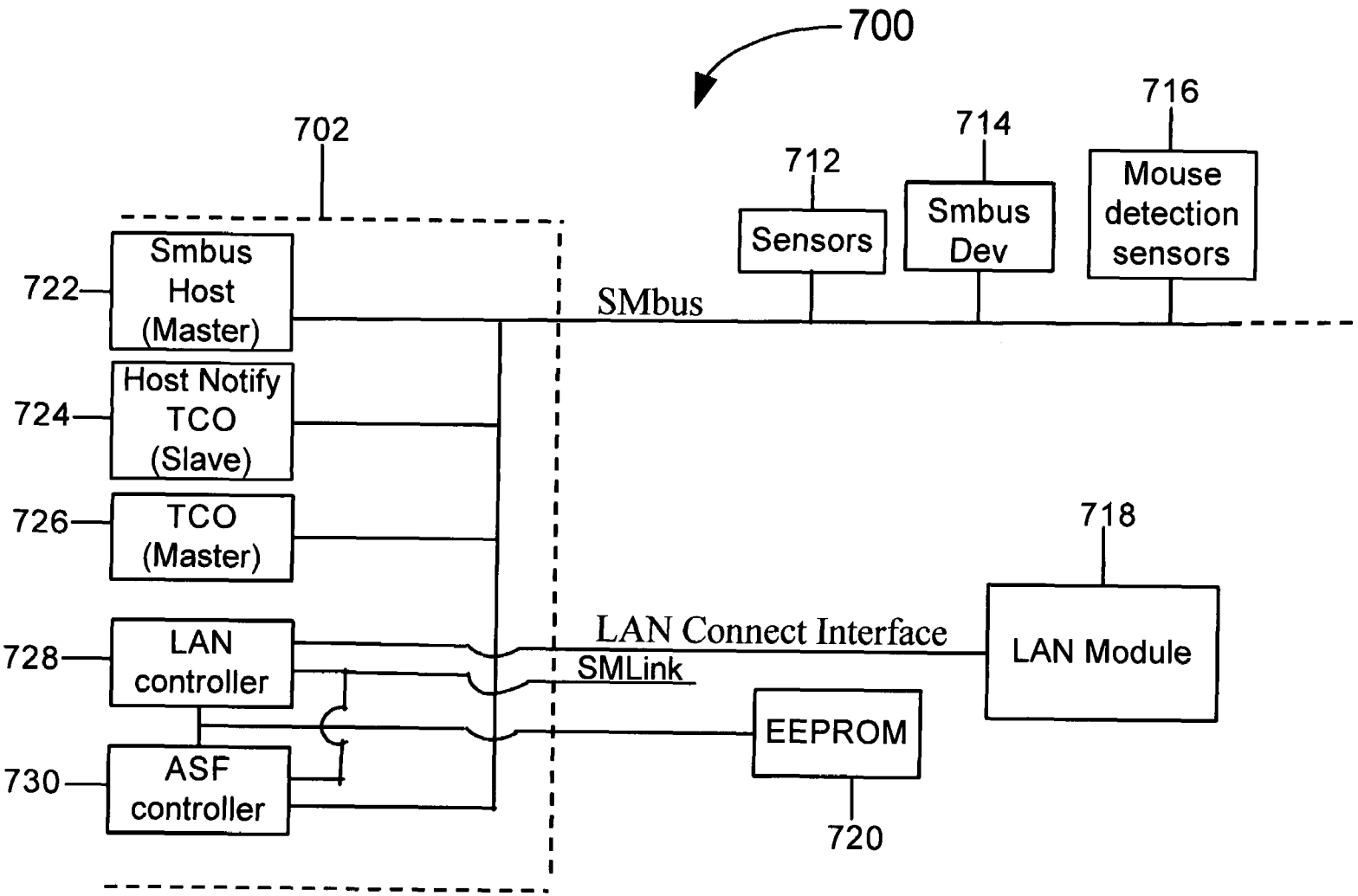
FIG. 7 illustrates a system according to some embodiments of the inventions.

FIG. 7 illustrates an ASF arrangement 700 including ASF architecture according to some embodiments. The ASF arrangement 700 includes ASF circuitry shown inside a dotted line 702 in FIG. 7, and also illustrates how the ASF circuitry 702 couples with sensors 712, SMBus Dev 714 (SMBus device) and MS (mouse) detection sensors 716 via a System Management bus (SMBus). All of the elements in FIG. 7 may be similar to or the same as the elements in FIG. 3. FIG. 7 adds mouse detection sensors 716 rather than keyboard/mouse detection sensors 316. It is noted however, that in some embodiments the ASF circuitry includes both mouse detection sensors and keyboard detection sensors, or these elements may be combined in one device.

Some embodiments have been illustrated herein as applying to a keyboard or applying to a mouse. However, such embodiments may be equally applicable to other peripherals as well. Further, some embodiments illustrated herein that have been shown as applying to a keyboard can apply to a mouse in some embodiments. Similarly, some embodiments illustrated herein that have been shown as applying to a mouse can apply to a keyboard in some embodiments.

Although some embodiments have been described in reference to particular implementations, other implementations are possible according to some embodiments. Additionally, the arrangement and/or order of circuit elements or other features illustrated in the drawings and/or described herein need not be arranged in the particular way illustrated and described. Many other arrangements are possible according to some embodiments.

In each system shown in a figure, the elements in some cases may each have a same reference number or a different reference number to suggest that the elements represented could be different and/or similar. However, an element may be flexible enough to have different implementations and work with some or all of the systems shown or described herein. The various elements shown in the figures may be the same or different. Which one is referred to as a first element and which is called a second element is arbitrary.

In the description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still co-operate or interact with each other.

An algorithm is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

Some embodiments may be implemented in one or a combination of hardware, firmware, and software. Some embodiments may also be implemented as instructions stored on a machine-readable medium, which may be read and executed by a computing platform to perform the operations described herein. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other form of propagated signals (e.g., carrier waves, infrared signals, digital signals, the interfaces that transmit and/or receive signals, etc.), and others.

An embodiment is an implementation or example of the inventions. Reference in the specification to "an embodiment," "one embodiment," "some embodiments," or "other embodiments" means that a particular feature, structure, or characteristic described in connection with the embodiments is included in at least some embodiments, but not necessarily all embodiments, of the inventions. The various appearances "an embodiment," "one embodiment," or "some embodiments" are not necessarily all referring to the same embodiments.

If the specification states a component, feature, structure, or characteristic "may", "might", "can" or "could" be included, for example, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Although flow diagrams and/or state diagrams may have been used herein to describe embodiments, the inventions are not limited to those diagrams or to corresponding descriptions herein. For example, flow need not move through each illustrated box or state, or in exactly the same order as illustrated and described herein.

The inventions are not restricted to the particular details listed herein. Indeed, those skilled in the art having the benefit of this disclosure will appreciate that many other variations from the foregoing description and drawings may be made within the scope of the present inventions. Accordingly, it is the following claims including any amendments thereto that define the scope of the inventions.

What is claimed is:

1. An apparatus comprising:

a PS2 connector to couple a PS2 peripheral, the PS2 connector including a first standard PS2 reserved pin and a second standard PS2 reserved pin; and a detector coupled to the PS2 connector to detect if the PS2 peripheral is disconnected from the PS2 connector in response to the first standard PS2 reserved pin and the second PS2 standard reserved pin.

2. The apparatus of claim 1, wherein the detector is to detect if the PS2 peripheral is connected to the PS2 connector in response to the first standard PS2 reserved pin and the second PS2 standard reserved pin.

3. The apparatus of claim 1, further comprising a controller to send an alert in response to the detecting.

4. The apparatus of claim 1, wherein the PS2 peripheral is a PS2 keyboard.

5. The apparatus of claim 1, wherein the PS2 peripheral is a PS2 mouse.

6. The apparatus of claim 1, wherein the PS2 connector includes a switch coupled to the first standard PS2 reserved pin and the second standard PS2 reserved pin, and wherein the detector is to detect if the PS2 peripheral is disconnected from the PS2 connector in response to the switch.

7. The apparatus of claim 1, wherein the detector includes a serial input/output sensor and an alert standard format controller.

8. A system comprising:

a PS2 peripheral including a first standard PS2 reserved pin and a second standard PS2 reserved pin; and a computer including a PS2 connector to couple the PS2 peripheral to the computer and a detector coupled to the PS2 connector to detect if the PS2 peripheral is disconnected from the PS2 connector in response to the first standard PS2 reserved pin and the second standard PS2 reserved pin.

9. The system of claim 8, wherein the detector is to detect if the PS2 peripheral is connected to the PS2 connector in response to the first standard PS2 reserved pin and the second standard PS2 reserved pin.

10. The system of claim 8, the computer further comprising a controller to send an alert in response to the detecting.

11. The system of claim 8, wherein the PS2 peripheral is a PS2 keyboard.

12. The system of claim 8, wherein the PS2 peripheral is a PS2 mouse.

13. The system of claim 8, wherein the PS2 connector includes a switch coupled to the first standard PS2 reserved pin and the second standard PS2 reserved pin, and wherein the detector is to detect if the PS2 peripheral is disconnected from the PS2 connector in response to the switch.

14. The system of claim 8, wherein the detector includes a serial input/output sensor and an alert standard format controller.

15. The system of claim 8, wherein the computer includes a controller to send an alert.

16. The system of claim 15, further comprising a console to receive the alert.

17. A method comprising:

coupling to a first standard PS2 reserved pin of a PS2 peripheral and a second standard PS2 reserved pin of the PS2 peripheral; and detecting a disconnection of the PS2 peripheral from a system in response to the first standard PS2 reserved pin and the second standard PS2 reserved pin.

18. The method of claim 17, further comprising detecting a connection of the PS2 peripheral to the system in response to the first standard PS2 reserved pin and the second standard PS2 reserved pin.

19. The method of claim 17, further comprising sending an alert in response to the detecting.

20. The method of claim 17, wherein the PS2 peripheral is a PS2 keyboard.

21. The method of claim 17, wherein the PS2 peripheral is a PS2 mouse.

22. The method of claim 17, wherein the detecting is to detect if the PS2 peripheral is disconnected from the PS2 connector in response to a switch between the first standard PS2 reserved pin and the second standard PS2 reserved pin.

* * * * *